United States Patent [19]

Secco

[11] Patent Number: 4,835,904

[45] Date of Patent: Jun. 6, 1989

[54] DEVICE FOR AUTOMATICALLY CLOSING WINDOWS

[75] Inventor: Renzo Secco, Treviso, Italy

[73] Assignee: Industrie Secco S.p.A., Treviso, Italy

[21] Appl. No.: 137,932

[22] Filed: Dec. 28, 1987

[30] Foreign Application Priority Data

Jan. 27, 1987 [IT] Italy ..... 84108 A/87

[51] Int. Cl.[4] ..... E05F 15/20

[52] U.S. Cl. ..... 49/7; 49/1

[58] Field of Search ..... 49/1, 7, 8

[56] References Cited

U.S. PATENT DOCUMENTS

| | | | |
|---|---|---|---|
| 1,249,013 | 12/1917 | Boyd | 49/8 |
| 2,878,906 | 3/1959 | Knebel | 49/1 |
| 3,189,142 | 6/1965 | Carlson | 49/7 |

*Primary Examiner*—James R. Brittain

*Attorney, Agent, or Firm*—Charles W. Fallow

[57] ABSTRACT

A device for automatically closing windows with vertically sliding sashes in the case of fire comprises at least one spring compensator (9) removably engaged with a lateral upright (3) of the cased frame (2) of the window and having its extractable core (14) connected to the sliding sash (1), a cord (15) fixed at one end to said compensator (9), fixed at its other end to said cased frame (2) and passing about an idler pulley (16) fixed to said cased frame (2) in a position above the two ends of said cord (15) in such a manner as to keep it under tension and ensure that said compensator (9) remains engaged with said cased frame (2), and a thermosensitive element (17) interposed along said cord (15) and acting to break its continuity if the predetermined temperature is exceeded.

4 Claims, 1 Drawing Sheet

DEVICE FOR AUTOMATICALLY CLOSING WINDOWS

BACKGROUND

This invention relates to a device for automatically closing windows with vertically sliding sashes, in the case of fire.

Windows are known comprising at least one sash vertically movable along guides between a lower closed position and an upper open position.

In order to facilitate the raising of the sash during opening and to stabilise the raised position reached, it is known to connect the sash to a pair of counterweights by corresponding cords passing about idle pulleys fitted to each upper corner of the window. Both the counterweights and the relative cords are slidingly housed in corresponding longitudinal compartments provided in the side sections of the cased frame of the window.

Devices for fitting to said windows in order to automatically close them in case of fire are also known. These known devices consist essentially of thermal sensors interposed in the cord portion between the window and counterweight and arranged to break the continuity of said cord when a predetermined temperature is exceeded. When a fire occurs, the temperature increase causes the sensors to act by breaking the continuity of the relative cord with the result that the balancing effect of the two counterweights on the window no longer exists and the sash automatically falls if in the raised position.

The drawback of this automatic window closure device is that it requires the use of a counterweight balancing system for the sash, i.e., a system which is bulky because of a its length and requires the use of channels of adequate crosssection to contain and guide them.

Spring compensator devices are also known for balancing the weight of the vertically sliding sashes. They consist essentially of a small-diameter tubular element internally housing a coil spring operating torsionally and fixed at its upper end to said tube and at its lower end to a cylindrical terminal axially immobile to the tube but free to rotate with respect to it. This cylindrical terminal comprises a diametrical slot traversed by a helically twisted metal strip. For use, the tubular element is fixed to the vertical channel or channels of the cased frame of the window, and the lower end of the helically twisted strip is fixed to the mobile sash while in the raised position. When the sash is lowered it causes the strip to emerge axially and, because of the fact that it cannot rotate as it is fixed to the sash, causes the cylindrical terminal to rotate and load the spring. When the window is closed, i.e., the sash lowered, the spring of the (or of each) balancing device is thus in a loaded state, and this facilitates the subsequent raising of the sash. In fact, the sash is generally provided with means for fastening it in its closed position, and when these are released they allow the sash to rise spontaneously.

These known spring compensators are considerably more advantageous than counterweight compensators because by being of smaller size they do not require the use of large channels and can substantially be installed within the interspace between the sash and cased frame in conventional windows. They also have the great advantage of being adjustable and allowing perfect balancing of the window independently of its weight.

However, known spring compensators cannot be used in fire-protected windows because in contrast to counterweight compensators their method of operation is such as to keep the sash raised in the absence of external streses.

An object of the invention is to provide a device which in the case of fire will automatically close vertically sliding sash windows which use conventional spring compensators.

A further object of the invention is to provide a device of the aforesaid type which can be easily installed in windows, including conventional windows.

A further object of the invention is to provide an operating device which can be easily inspected and reactivated after it has acted.

SUMMARY OF THE INVENTION

All these and further objects, which will be apparent from the description given hereinafter, are attained according to the invention by a device for automatically closing windows with vertically sliding sashes in the case of fire, comprising:

at least one spring compensator removably engaged within a lateral upright of the cased frame of the window and having its extractable core connected to the sliding sash, a cord fixed at one end to said compensator, fixed at its other end to said cased frame and passing about an idler pulley fixed to said cased frame in a position above the two ends of said cord in such a manner as to keep it under tension and ensure that said compensator remains engaged with said cased frame, and a thermosensitive element interposed along said cord and acting in the sense of breaking its continuity if the predetermined temperature is exceeded.

BRIEF DESCRIPTION OF THE DRAWINGS

A preferred embodiment of the present invention is described in detail hereinafter with reference to the accompanying drawings, in which.

DESCRIPTION OF THE PREFERRED EMBODIMENT

Figure 1:
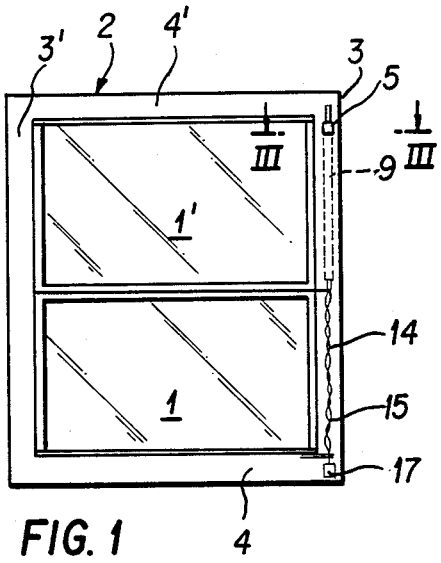
FIG. 1 is a frontal diagrammatic view of the device according to the invention fitted to a window with vertically sliding sashes.
Figure 3:
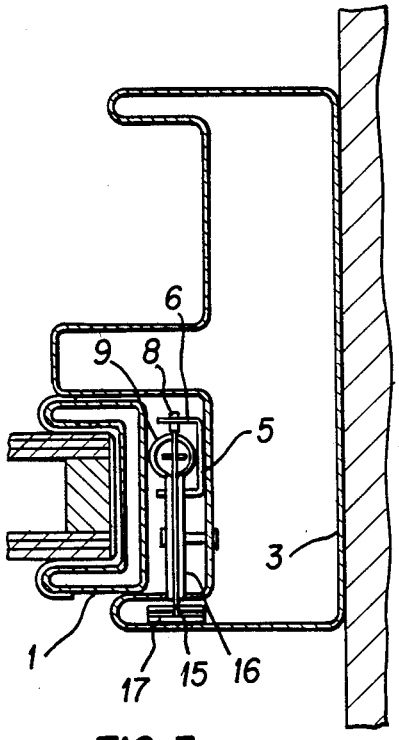
FIG. 3 shows a portion of the window in the form of a diagrammatic section to an enlarged scale on the line III—III of FIG. 1.
Figure 2:
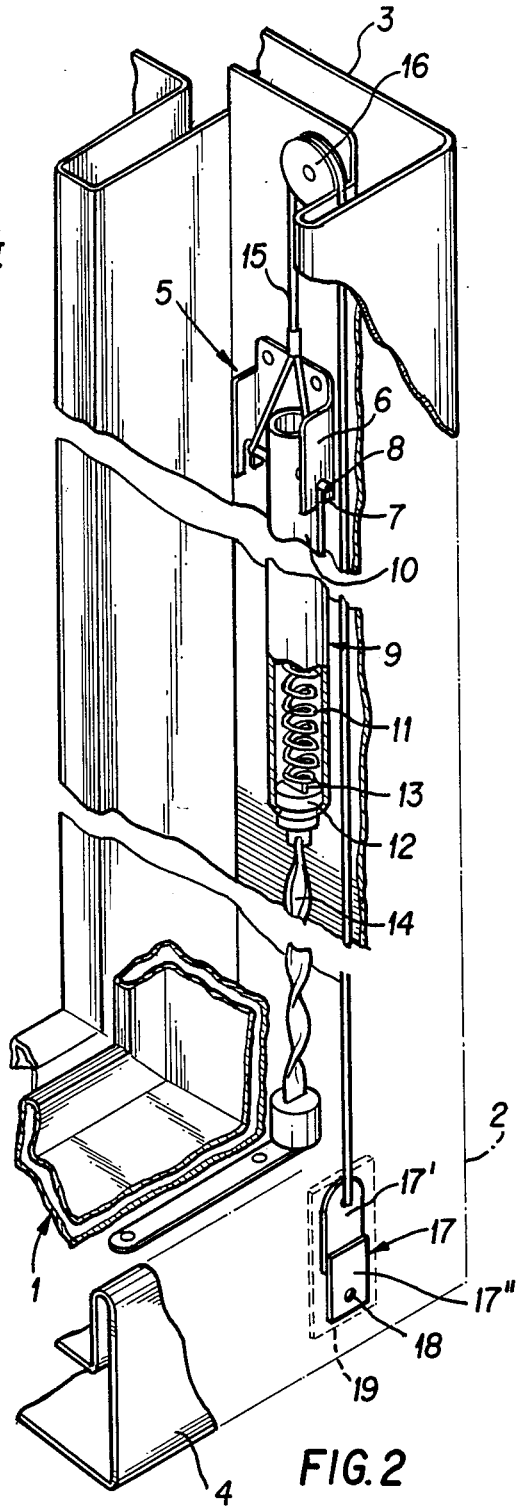
FIG. 2 is an enlarged partial perspective view thereof.

As can be seen from the figures, the device according to the invention is applied to a window comprising two sashes 1,1' which can slide within a cased frame indicated overall by 2 and comprising two vertical uprights 3,3' and two horizontal cross-members 4,4'. In the illustrated example, the constituent sections of the sashes 1, 1' and cased frame 2 are of conventional type and require no further description.

A support bracket 5 provided in each side piece 6 with a downwardly open slot 7 is fitted to the upper portion of the upright 3. A transverse peg 8 provided at the upper end of a spring compensator 9 removably engages in the facing slots 7. This compensator is of conventional type and comprises a cylindrical tube 10 housing a coil spring 11, which is fixed at its upper end to said tube and at its lower end to a terminal 12 which can rotate relative to said tube 10 but cannot move axially with respect thereto. The terminal 12 has a diametrical slot 13 through which a core 14 consisting of a helically twisted metal strip can pass. The lower end of said core 14 is fixed to the lower cross-member of the sash 1.

A cord 15 is fixed at one end to the transverse peg 8, passes around a pulley 16 positioned at the top of the upright 3, and is fixed at its other end to the lower end of said upright 3 by way of a thermal sensor 17. The thermal sensor is of conventional type and consists essentially of two plates 17',17'' held together by any low-melting point material. The upper plate 17' is fixed to the cord 15 whereas the lower plate 17'' is fixed to the lower cross-member 4 of the cased frame, for example by means of screw 18.

For inspection and/or resetting purposes, that portion of the frame secton 3 facing the thermal sensor 17 is replaced by a removable door 19.

The arrangement described with reference to one side of a sash can also be provided on the other side of the sash, and on both sashes in the case of a two-sash window, although further reference thereto is omitted herein for reasons of simplicity.

The operation of the device according to the invention is as follows.

In normal use, the cord 15 keeps the peg 8 of the cylindrical tube 10 engaged in the slots 7 of the support bracket 5 to secure the tube to the upright 3 with no possibility of relative axial or rotational movement.

When the sash 1 is raised, the core 14 is completely contained in the tube 10 and the spring 11 is in its minimum loaded state. To close the window, the sash is lowered. The lowering of the sash causes the core 14 to withdraw axially from the tube 10 and, by virtue of its engagement with the terminal 12, cause this latter to rotate and consequently load the spring 11. When the sash has been completely lowered, the spring 11 is in its maximum loaded state and the window is kept closed by conventional sash fastening means, not shown on the drawing for simplicity.

To open the window it is necessary only to release these means to enable the elastic reaction of the spring 11 to raise the sash 1. In the case of fire, when the temperature required to operate the thermal sensor 17 is reached, this latter releases the cord 15 which then allows the tube 10 to disengage from the support bracket 5. More specifically, if the sash is in the raised position it falls by gravity into the closed position, dragging the spring compensator 9 with it. If it is already lowered, the breakage of continuity of the cord 15 causes only the spring compensator 9 to fall, dragged downwards by the elastic reaction of the spring 11.

From the aforesaid it is apparent that the device according to the invention allows, in the case of fire, automatic closure of windows of the vertically sliding sash type fitted with conventional spring compensators. Moreover, it is very simple to install in the window and equally simple to reset after it has operated.

The thermal sensor 17 can obviously be interposed at any point of the cord 15, even though in it is preferably located in the position shown on the drawings, i.e., in the region which is most important to monitor while at the same time being that which is most easily accessible.

I claim:

1. A device for automatically closing a vertically sliding sash installed in a window frame, and coacting with a lateral upright of the frame, in case of fire, comprising at least one spring compensator with a lateral surface removably engaged with the lateral upright of the window frame and having an extendible core connected to the sliding sash, an idler pulley fixed to said window frame upright above said compensator, a cord fixed at one end to said compensator, and attached at its other end to said window frame and passing over said idler pulley fixed to said window frame in such a manner as to remain under tension and ensure that said compensator remains engaged with said window frame, a thermosensitive element interposed along said cord, for breaking the continuity of the cord when a predetermined temperature is exceeded, a bracket for supporting the compensator, said bracket comprising a U-shaped plate having a central web fixed to the window frame upright and two lateral flanges having respective downwardly open slots, and a pair of transverse pegs projecting from the lateral surface of the spring compensator, normally engaged within said slots.

2. The invention of claim 1, wherein the spring compensator is housed in a vertical space between the sash and the window frame upright, the idler pulley being positioned substantially at an upper end of the upright, and that portion of the cord extending between the idler pulley and the end of the cord fixed to the window frame being housed within said upright.

3. The invention of claim 1, wherein said thermosensitive element comprises two metal elements bonded together by a low melting-point material, one of said elements being fixed to the end of the cord, and the other end being fixed to the window frame.

4. The invention of claim 1, further comprising an inspection door for providing access to the thermosenititve element.

* * * * *